United States Patent [19]

Knott

[11] Patent Number: 4,500,194

[45] Date of Patent: Feb. 19, 1985

[54] DEVICE FOR REGENERATING THE CARRIER PARTICLES OF A TWO-COMPONENT DEVELOPER CONSISTING OF CARRIER PARTICLES AND TONER

[75] Inventor: Joseph Knott, Tutzing, Fed. Rep. of Germany

[73] Assignee: Siemens Aktiengesellschaft, Berlin and Munich, Fed. Rep. of Germany

[21] Appl. No.: 365,391

[22] Filed: Apr. 5, 1982

[30] Foreign Application Priority Data

Apr. 15, 1981 [DE] Fed. Rep. of Germany ..... 3115331

[51] Int. Cl.[3] ..... G03G 15/06

[52] U.S. Cl. ..... 355/3 DD; 209/128; 355/3 R; 430/137

[58] Field of Search ..... 355/3 R, 3 DD, 10; 430/137; 209/127 R, 127 B, 127 C, 128

[56] References Cited

U.S. PATENT DOCUMENTS

| | | | |
|---|---|---|---|
| 2,224,169 | 12/1940 | Turnbull | 209/127 R X |
| 3,477,568 | 11/1969 | Madrid | 209/127 R |
| 3,507,686 | 4/1970 | Hagenbach | 430/137 X |
| 3,801,196 | 4/1974 | Knapp et al. | 355/4 X |
| 3,879,335 | 4/1975 | Storck et al. | 430/137 X |
| 3,960,738 | 6/1976 | O'Brien et al. | 430/137 |
| 4,076,640 | 2/1978 | Forgensi et al. | 430/137 |

*Primary Examiner*—Fred L. Braun

*Attorney, Agent, or Firm*—Hill, Van Santen, Steadman & Simpson

[57] ABSTRACT

Developer mix is regenerated in a manner which removes toner crusts from carrier particles in order to extend the useful time of a developer mix within a developer station of an electrophotographic printing or copying machine. A portion of the developer mix is continuously removed from the main body of developer mix in the developer station and supplied to a regenerator device where the developer particles are swirled and impacted to flake off the toner crust formations. The regenerator device is formed with a discharge opening for removal of the cleaned or regenerated developer mix. The discharge nozzle is connected to a recirculation line through which the regenerated mix is conducted back into the developer station. The regenerator device is further provided with an extraction opening for removing the flaked off crust particles to a separate area, such that crust particle deposits are prevented from building up in the regenerator device.

16 Claims, 2 Drawing Figures

DEVICE FOR REGENERATING THE CARRIER PARTICLES OF A TWO-COMPONENT DEVELOPER CONSISTING OF CARRIER PARTICLES AND TONER

BACKGROUND OF THE INVENTION

The invention relates generally to apparatus for controlling the quality of a magnetizable developer mix for use in an electrophotographic printing machine developer and, more particularly, concerns a device for regenerating the carrier particles of a developer mix such that regenerated carrier particles are stripped of toner component crust during recycling.

According to electrophotographic or electrographic principles typically utilized in non-mechanical copying or printing machines, electrostatic latent images of characters to be printed are generated on a recording medium, such as a photoconductive drum or specially treated paper. These electrostatic images are subsequently inked with a print powder, called toner particles and which is typically black, in a developer station. The developer station typically includes at least one developer unit generally referred to in the art as a magnetic brush developer. A magnetic brush developer, as a rule, utilizes a two-component magnetizable developer mix for developing the latent charge images recorded on the recording medium. The two components of the developer mix consist of ferro-magnetic carrier particles and toner particles which contain synthetic components. The carrier particles are covered with a very thin, adhering synthetic or oxide layer, which, in the tribo-electric voltage series, lies far apart from the synthetic component of the toner so as to produce mutual forces of attraction. A magnetic brush arrangement serves to conduct developer mix particles past the charge images formed on the recording medium, whereupon the toner adheres to the charge images as a result of electrostatic forces.

The concentration of toner particles within the developer mix, i.e., the percentage of toner particles relative to carrier, relates directly to the characteristics of the developed images. For example, the density of the image will be affected by the toner particle concentration. Undesirable decrease in toner concentration in the developer is prevented by means for periodically adding new toner particles to the developer mix. One system adapted for regulating toner powder concentration within a particulate mixture utilized in a developer is disclosed, for example, in U.S. Pat. No. 3,801,196. There, toner powder concentration is measured as a function of the intensity of light rays transmitted by a reflector means having toner powder adhering thereto.

Due to the constant intermingling of carrier and toner particles in a developer mix, a layer of synthetic material, which is a component of the toner, becomes deposited on the synthetic or oxide layer of the carrier particles. This synthetic material causes a crust to form on the carrier particles, the thickness of which becomes greater and greater with time such that the tribo-electrical forces between the carrier and toner particles are gradually reduced. This reduction of the tribo-electrical forces may eventually render the developer mix unuseable, requiring complete replacement of the mix. In the case of fast copiers or printers, this crusting process necessitates that developer mix be replaced often and in very short time intervals in order to maintain suitable printing or copying quality. The frequent replacement of the developer mix causes frequent and long downtimes of the printer or copier. Furthermore, as the crusting process occurs, printing quality becomes reduced in direct correlation with the increasing age of the developer mix. In addition, since conventional monitoring devices for measuring toner concentration in the developer mix do not discount or make allowance for the crust component of the carrier particles, inaccurate toner concentration measurements result and frequently indicate toner concentration actually increasing with the age of the developer mix. For example, the crust component in old developer mix can amount to 60–80 percent of the measured toner concentration.

An object of the present invention is to eliminate the need for frequent replacement of developer mix in a developer unit and, at the same time, substantially maintain the printing or copying quality of character images being developed.

SUMMARY OF THE INVENTION

Deterioration of the efficacy of developer mix particles, especially that caused by the crusting of carrier particles with synthetic components coming from the toner particles, is avoided via the invention device through which developer mix is continuously regenerated to flake off the toner crust formed on the carrier particles. In accordance with the invention, small amounts of developer mix are removed from the developer station and supplied to the regeneration device which accelerates and swirls the developer particles into engagement with each other and against body surfaces to effect flaking of the toner crust. Then, the developer mix particles are returned to the developer station for recycling into the main body of developer mix. Consequently, there results a longer aging characteristic for the developer mix being used in the developer unit. The flaked-off toner crust components are substantially removed from the regeneration device prior to recycling.

In accordance with a first embodiment, the regenerator device comprises a chamber disposed in communication with the main body of developer mix at the floor of the developer unit via a passageway through which a portion of the mix is passed into the chamber. A rotary device is disposed in the chamber, which may have rotor blades connected thereto, to exert accelerating forces on the mix portion and swirl them against the chamber walls. As a result of the impact forces upon the carrier particles of the mix, toner crusting is flaked off. The rotor device is connected for rotation to a rotary motor disposed outside of the chamber.

The passageway communicating between the developer unit and the chamber is nozzle-shaped and centrally contains an extended portion of the rotor shaft. In this manner, the intake amount of developer mix falling into the chamber can be precisely metered. By virtue of the extended portion of the rotor shaft, blockage of the passageway is avoided. Blockage of the passageway is further prevented in that the passageway nozzle expands conically in the direction toward the chamber interior.

The chamber further contains a discharge aperture positioned in the floor of the chamber which is also nozzle-shaped, conically expanding in the direction toward the chamber interior so that blockage in the discharge aperture is also prevented. Regenerated developer mix is removed from the chamber through the discharge aperture by gravity fall and a suction pressure formed in a compressed air flow line which serves to conduct the regenerated developer mix back to the developer station. The suction pressure may be formed in the compressed air line by suitable means, such as a jet pump arrangement disposed directly beneath the lower open end of the discharge aperture.

The toner crusts arising in the regeneration chamber are substantially all suctioned off through an extraction aperture disposed adjacent the upper end of the chamber, since these lighter, smaller particles will tend to billow upwardly from the developer mix portion being treated in the chamber on an ambient air flow passing upwardly through the chamber from beneath the rotor blade to the extraction aperture under the suction force connected thereto. The ambient air opening in the chamber is preferably formed concentric about the entry location of the rotor shaft. In this manner, dust arising from the swirling of the developer mix particles in the chamber is prevented from passing downwardly along the shaft and contaminating the motor bearings. The intake passageway from the developer station is preferably located so as to deposit developer mix portion particles directly onto the rotor blade for swirling outward under centrifugal forces, such that a back-up of developer mix particles in the intake passageway is prevented.

In accordance with a second embodiment of the invention, the regeneration device comprises a swirl chamber disposed beneath the developer unit having a source of compressed air directed tangentially into the chamber, which is substantially cylindrical for placing the developer mix portion being regenerated into rotation. A nozzle-shaped passageway serves to direct a developer mix portion flow from the developer unit into the regenerator chamber, which nozzle shape expands conically in the direction towards the chamber interior. The swirling motion of the developer mix particles effects impacting which causes the removal of the toner crusts from the carrier particles. A discharge pipe connected to a source of suction pressure has an open end disposed significantly radially inward of the chamber for conducting regenerated developer mix from the chamber to a compressed air flow carrier line which returns the regenerated mix to the developer station. An extraction aperture is located in an outward radial portion of the chamber connected to a source of suction pressure for extracting the toner crusts arising in the chamber during regeneration of the developer mix.

The developer mix regenerator device of the present invention serves to maintain printing quality at a substantially constant high level as the result of maintaining the developer mix particles in substantially original condition. Furthermore, the useful life of the developer mix is considerably extended since aging of the developer mix typically brought about by the toner crusting of carrier particles is the major factor effecting developer useability. The disruptive influence of the toner crust components arising in a developer mix is eliminated by virtue of the inventive regenerator device. In this regard, the flow behavior of the developer mix in the developing station stabilizes. As a result of the longer use time afforded developer mix by virtue of the present invention, the operating costs of the developer station is greatly reduced and down time for the printer or copier typically due to the frequent intervals needed for developer replacement are considerably reduced.

DESCRIPTION OF THE PREFERRED EMBODIMENTS

Figure 1:
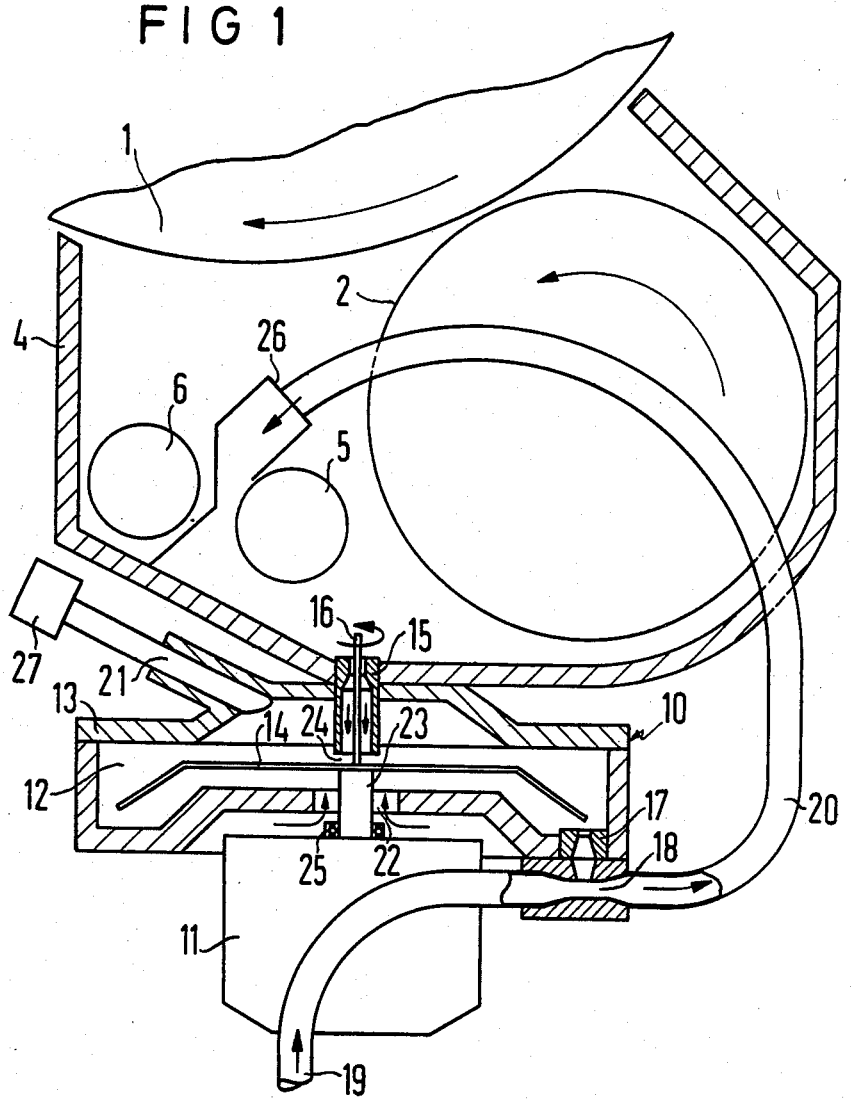
FIG. 1 is a schematic, side elevational cross-sectional view of a developer station having a developer mix regenerator device constructed in accordance with a first embodiment of the invention.

FIG. 1 schematically illustrates a magnetic brush developer unit 4 of a type known in the art for use in an electrophotographic printing or copying machine adapted with the present invention. A drum 1 having an annular photoconductive surface is mounted for rotation within the machine frame (not shown). Not shown, but positioned about the drum 1, are conventional character generator stations for making electrostatic latent charge images on the photoconductive drum surface of the characters to be copied or printed. The drum subsequently conducts the charge images through the developer station 4 where the charge images are inked. After the photoconductive drum surface is passed through the developer station, the inked charge images are transferred to a paper web in a known manner at a transfer station. The developer unit 4, in accordance with magnetic brush developer principles, contains a magnetizable two-component developer mix consisting of carrier granules and toner particles. A magnetic brush or drum 2 is rotatably mounted in the developer unit for continually bringing developer mix into contact with the electrostatic latent images recorded on the photoconductive drum surface. At the photoconductive drum surface, a portion of the toner particles carried by the rotatable drum 2 is transferred to the charged images and the remainder is dropped back onto the main body of developer mix contained in the developer unit. A mixing drum 5 is mounted for rotation within the developer unit in contact with the developer mix particles for continuously mixing of the mixed body. The developer mix is replenished with fresh toner particles by means of a dispensing roll 6 mounted in a compartment containing a supply of toner for adding toner particles to the main body of developer mix.

A regenerator device 10 is disposed beneath the floor of the developer unit 4 for receiving a substantially continuous flow from the main body of developer mix. During the course of operation of the developer unit, the efficacy of the developer mix reduces with age, primarily as the result of crusting formed on the carrier particles by synthetic components of the toner. The regenerator device 10 serves to flake toner crust portions off of the carrier particles, thereby rejuvenating treated portions of the developer mix. The regenerator device 10 comprises a substantially cylindrical chamber 12 in which a rotor 14, having an annular continuous rotor blade or a plurality of circumferentially spaced rotor blades, secured to a driveshaft 23 of a suitable rotary motor 11 for driven rotation within the chamber 12. The chamber 12 is substantially closed across its upper end with a cover plate 13 which abuts against the floor of the developer unit 4.

An intake nozzle 15 is disposed in the chamber cover 13 to provide particle flow communication between the floor of the developer unit and the interior of the regenerator chamber. The intake end of the nozzle 15 is preferably located forwardly of the mixing roll 5, so that developer mix may be prodded into the inlet opening of the intake nozzle 15 for passage into the chamber 12. The flow amount of developer mix passing into the chamber 12 can be metered by the inlet diameter of the intake nozzle 15. Furthermore, an upstanding stub shaft 16 is formed on the free end of the driveshaft 23 for projecting upwardly through the passageway of the nozzle 15 into the developer unit 4. The cross-section of the shaft 16 may be used to control metering of developer mix passing through the nozzle 15, such as by flattening one or more sides of the shaft 16. As the result of rotation of the shaft 16, blockage of the inlet opening to the nozzle 15 is substantially avoided since developer mix particles are not permitted to settle across the nozzle inlet. The discharge end of the nozzle 15 is disposed overlying the rotor 14 so that deposited developer mix particles are immediately swirled away into the chamber 12. This arrangement serves to prevent blockage of flow through the nozzle 15, since back-up of particles in the nozzle is prevented. In addition, the nozzle passageway conically expands in the downward direction into the chamber interior to prevent particle flow blockage.

Rotation of the rotor 14 serves to swirl up the developer mix arriving in the chamber 12 through the intake nozzle 15. Due to the impact effect of the rotor against the carrier particles and due to the friction of the whirled carrier particles against the walls of the chamber 12, the toner crust is stripped or flaked from the carrier particles. The rotor blade or blades are shaped in such a manner that the deposited developer mix is conducted radially outward of the driveshaft 23 toward the surrounding walls of the chamber 12.

A discharge nozzle 17 is disposed through the lower wall of the chamber 12 adjacent the surrounding wall of the chamber for removal of regenerated developer mix from the chamber. The nozzle 17 is formed with a passageway which expands conically downward from the interior of the chamber 12. The discharge of regenerated developer mix from the chamber 12 is promoted by the stirring action of the rotor 14 which serves to pass developer mix over the inlet opening of the discharge nozzle 17 and is further promoted by a source of suction pressure which communicates with the passageway of the discharge nozzle. This suction pressure is caused by a pressurized air stream 19 which passes through a carrier line or tube 20 beneath the outlet of the discharge nozzle 17. The pressure line 20 is formed with a jet pump-like device 18 having an opening communicating with the discharge nozzle 17 for extracting a flow of developer particles from the nozzle 17. The regenerated developer mix drawn from the discharge nozzle 17 is recycled back into the developing station 4 along the carrier line 20 buoyed by the pressurized air 19 flowing therethrough. The pressure line 20 terminates in a discharge nozzle means 26 in the developer unit 4 through which the recycled developer mix, now regenerated, passes into communication with the mixing roll 5 for replacement in the main body of developer station mix.

The toner crusts arising in the form of fine ground powder within the chamber 12 are substantially all removed therefrom through an extraction opening 21 disposed in the chamber cover 13. The extraction opening communicates with a suitable source of suction pressure 27 which serves to draw the toner crust particles through the opening 21 and out of the regenerator chamber 12. In this manner, the regenerator chamber 12 is kept substantially clean of toner crust portions and deposits of toner and toner crusts in the chamber 12 are prevented. The air which is suctioned out through the extraction opening 21 is drawn into the chamber 12 through a circular opening 22 formed in the base of the chamber 12. The opening 22 is preferably located about the driveshaft 23 underlying the rotor 14 to prevent the loss of developer mix particles from the chamber. By virtue of the air flow upwardly into the chamber through the opening 22, there is a further advantage that contamination of the driveshaft bearing 25 with developer particles and dust is prevented.

Figure 2:
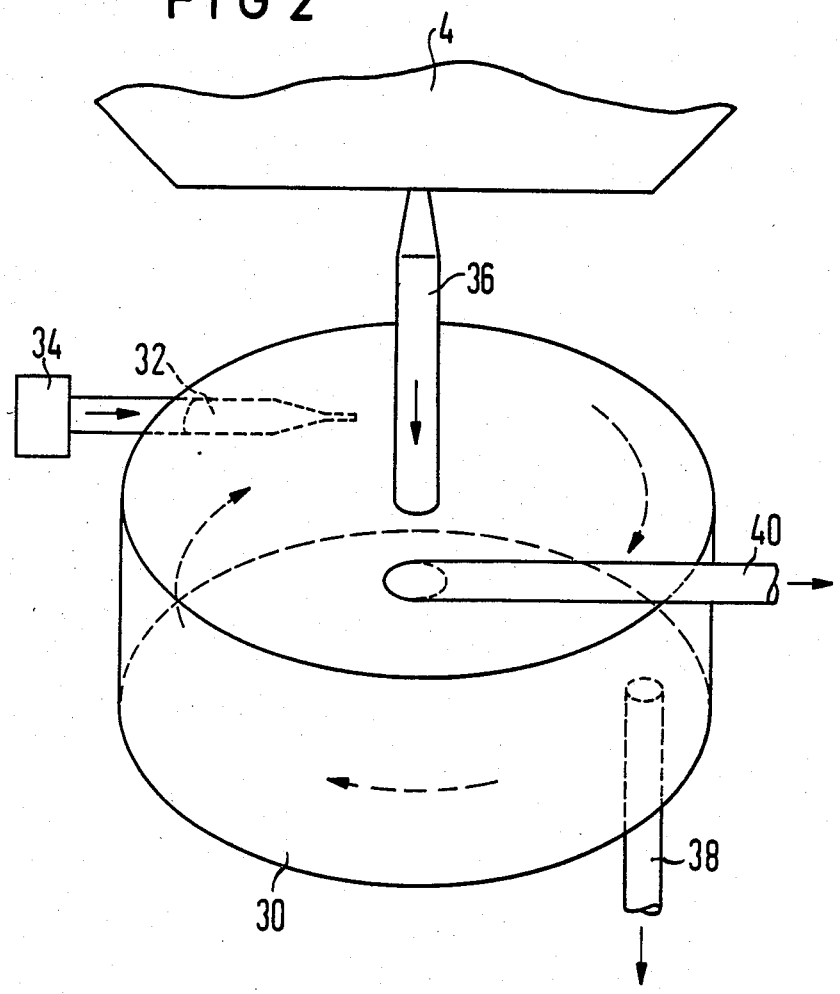
FIG. 2 is a schematic, perspective view of a developer mix regenerator device according to a second embodiment of the invention.

FIG. 2 illustrates a further embodiment regenerator device in accordance with the present invention. In accordance with this embodiment, the flaking of toner crusts from developer mix carrier particles is achieved by means of swirling impact brought about by a relatively high speed flow of compressed air. A substantially cylindrical regenerator chamber 30 is disposed beneath the floor of the developer unit 4 for receiving therein a flow of developer mix particles from the main body of developer mix in the developer station. A nozzle pipe 32 connected to a suitable source of compressed air 34 is disposed in the sidewall of the chamber 30. The discharge of the nozzle pipe 32 directs compressed air substantially tangentially relative to the circumference of the chamber sidewall. The tangentially introduced compressed air places the developer mix contained within the chamber 30 into substantially violent rotation, such that the rotating carrier particles are pressed against the chamber wall as a result of centrifugal forces. The friction effect arising both between the carrier particles relative to one another as well as between the carrier particles and the chamber wall strips or flakes the toner crusts. In this manner, developer mix contained within the chamber 30 is regenerated.

The flow of developer mix into the chamber 30 is conducted through a nozzle-shaped pipe 36 communicating at its upper end with the floor of the developer unit 4 and at its open lower end with the interior of the regenerator chamber 30. Blockage in the pipe 36 is substantially avoided in that the nozzle shape of the pipe extends conically downwardly in the conveying direction of the developer mix. In addition, the inlet end of the pipe 36 is disposed forward of the mixing roll 5 in the manner of the intake nozzle 15 described above.

A discharge pipe 38, preferably shaped with a nozzle passageway in the manner of the discharge nozzle 17 described above, is disposed in the floor of the chamber 30 adjacent to the chamber sidewall. The discharge pipe 38 serves to remove regenerated developer mix from the chamber 30 and can be connected to a source of suction pressure and a recycle carrier line for return of the regenerated developer mix to the developer station 4 in the manner of elements 18, 19, 20, and 26 described above.

The toner crust portions arising in the chamber 30 during the regeneration process are substantially all removed from the regeneration chamber through an extraction pipe 40. The extraction pipe 40 is connected to a suitable source of suction pressure and has an inner free end opening disposed within the central, radially inward area of the chamber 30, since, as the result of the centrifugal forces arising in the chamber, these lighter weight toner crust particles or powder will deposit radially inward of the relatively heavier carrier and toner particles of the developer mix swirling about the regenerator chamber. In order to assure continuous, free cycling of regenerated developer mix particles from the inventive regenerator device and the developer unit, it is contemplated that the carrier line 20 should be of a higher flow capacity then the discharge nozzle 17 or discharge pipe 38. Further, the discharge nozzle or pipe should in turn have a higher throughput capacity for developer mix particles than the intake nozzle or pipe 13 and 36. In this way, possible overfilling or blockage of the regenerator chambers 12 or 30 can be avoided.

In the illustrated embodiments of FIGS. 1 and 2, the regenerator device may be connected by flanges directly to the floor of the developer unit 4. However, it is also within the contemplation of the present invention that the regenerator devices not be connected to the developer unit, but be mounted outside of the copier or printer device housing. In such instances, the aged developer mix portion must be conveyed from the developer unit to the regenerator device for removal of the toner crusts from the carrier particles, whereupon the regenerated or cleaned developer mix is reintroduced back into the main body of developer mix at the developer station.

Although various minor modifications may be suggested by those versed in the art, it should be understood that I wish to embody within the scope of the patent warranted hereon all such modifications as reasonably and properly come within the scope of my contribution to the art.

I claim as my invention:

1. Apparatus for regenerating a developer particulate mix comprising carrier and toner particles contained in a developer unit adapted to deposit toner particles on an image bearing member comprising a chamber, an intake passage means for conducting said mix from said developer unit to said chamber, means for swirling said mix in said chamber in order to effect regenerative stripping of toner crust formations from carrier particles, and a discharge passage means for conducting regenerated mix from said chamber, said discharge passage means having an outlet end connected to a carrier line containing a pressurized air flow for conducting regenerated mix therethrough, said carrier line leading from said discharge passage means to said developer unit.

2. The apparatus of claim 1, wherein said means for swirling comprises a rotor disposed for rotation on a motor-driven shaft in said chamber.

3. The apparatus of claim 2, wherein a further shaft is connected for rotation with said motor-driven shaft and extends into said intake passage means to prevent blockage of said mix therein.

4. The apparatus of claim 3, wherein the outlet end of said intake passage means and said further shaft are coaxial with said motor-driven shaft, said further shaft being directly connected to said motor-driven shaft.

5. The apparatus of claim 3, wherein said intake passage means is nozzle-shaped expanding conically in the direction of said chamber.

6. The apparatus of claim 2, further comprising an extraction passage means communicating with said chamber connected to a source of suction pressure for removing stripped off toner crust formations from said chamber.

7. The apparatus of claim 6, further comprising an entry opening in said chamber about said motor-driven shaft communicating with ambient for providing an airflow to said source of suction pressure.

8. The apparatus of claim 2, wherein said intake passage means has its outlet end perpendicularly facing said rotor for impacting mix against said rotor.

9. The apparatus of claim 1, wherein said carrier line is formed with means communicating with said discharge passage means and producing a suction pressure in said discharge passage means.

10. The apparatus of claim 1, wherein said discharge passage means is nozzle-shaped expanding conically in the direction of said carrier line.

11. The apparatus of claim 1, wherein said means for swirling comprises a nozzle pipe communicating with said chamber and connected to a source of pressurized gas whereby to emit a pressurized gas flow placing said mix into rotation within said chamber.

12. The apparatus of claim 11, wherein said chamber has a substantially cylindrical sidewall and said nozzle pipe directs said pressurized gas flow substantially tangentially of said sidewall.

13. The apparatus of claim 11, further comprising an extraction pipe extending into said chamber having an inlet and disposed adjacent said chamber central interior and an outlet end connected to a source of suction pressure for removing stripped off toner crust formations from said chamber.

14. The apparatus of claim 1, further comprising an extraction passage means communicating with said chamber connected to a source of suction pressure for removing stripped off toner crust formations from said chamber.

15. The apparatus of claim 1, wherein said intake passage means has its inlet end disposed in the floor of said developer unit underlying a main body of developer mix and is nozzle-shaped expanding conically in the direction of said chamber.

16. The apparatus of claim 1, wherein said discharge passage means is nozzle-shaped expanding conically in the direction away from said chamber.

* * * * *